US005667192A

United States Patent [19]

Van Doren

[11] Patent Number: 5,667,192

[45] Date of Patent: Sep. 16, 1997

[54] CONCRETE PANEL CONSTRUCTION AND MOLD

[75] Inventor: David A. Van Doren, Hays, Kans.

[73] Assignee: Waffle-Crete International, Inc., Hays, Kans.

[21] Appl. No.: 370,868

[22] Filed: Jan. 10, 1995

Related U.S. Application Data

[63] Continuation-in-part of Ser. No. 247,060, May 20, 1994.

[51] Int. Cl.[6] ..... B28B 7/00

[52] U.S. Cl. ..... 249/82; 249/111; 249/155; 249/160; 249/165; 249/167; 249/168; 249/170; 249/189; 425/156

[58] Field of Search ..... 249/60, 82, 155, 249/111, 156, 160, 161, 163, 165, 167, 168, 170, 172, 189, 192; 425/156

[56] References Cited

U.S. PATENT DOCUMENTS

| | | | |
|---|---|---|---|
| 1,598,797 | 9/1926 | Wood | 249/161 |
| 2,560,783 | 7/1951 | Scott | 249/160 |
| 3,173,175 | 3/1965 | Lemelson | 425/156 |
| 4,181,286 | 1/1980 | Van Doren | 249/82 |
| 4,817,911 | 4/1989 | Infanti | 249/82 |

*Primary Examiner*—Robert J. Warden
*Assistant Examiner*—Hien Tran
*Attorney, Agent, or Firm*—Chase & Yakimo

[57] ABSTRACT

A mold especially adapted for forming precast, waffle-shaped concrete panels employs a one-piece mold body of flexible plastic sheet material to which rigid side rails are secured by tongue and groove longitudinal joints. The mold may be rapidly stripped and reset due to a hinge action provided by partial sides of the flexible body to which the rigid side rails are joined. The side rails and other structural features provide a simple mold structure that may be readily and efficiently employed for on-site production of panels. The configuration of the side rails and associated joints facilitates the replacement of a wornout mold body. A cover may be placed over the mold body while the concrete cures and automatically lifted therefrom after a predetermined time to allow the concrete to cool. Recess formers and connector covers for the panels are provided for appearance and security.

7 Claims, 10 Drawing Sheets

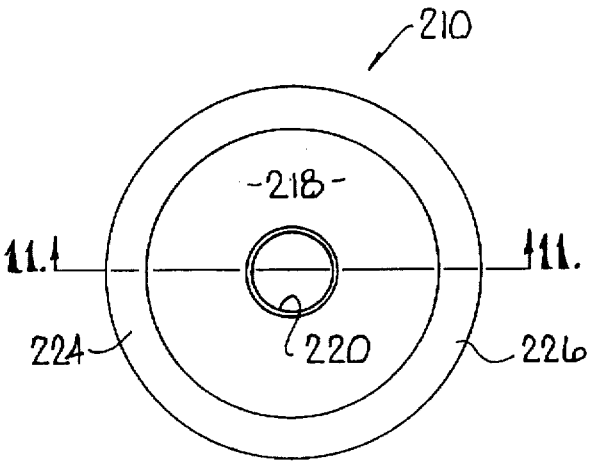
Fig. 10
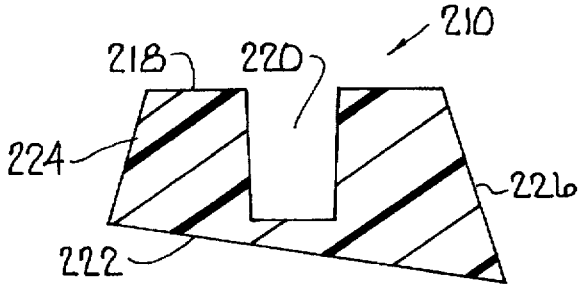
Fig. 11
Fig. 12
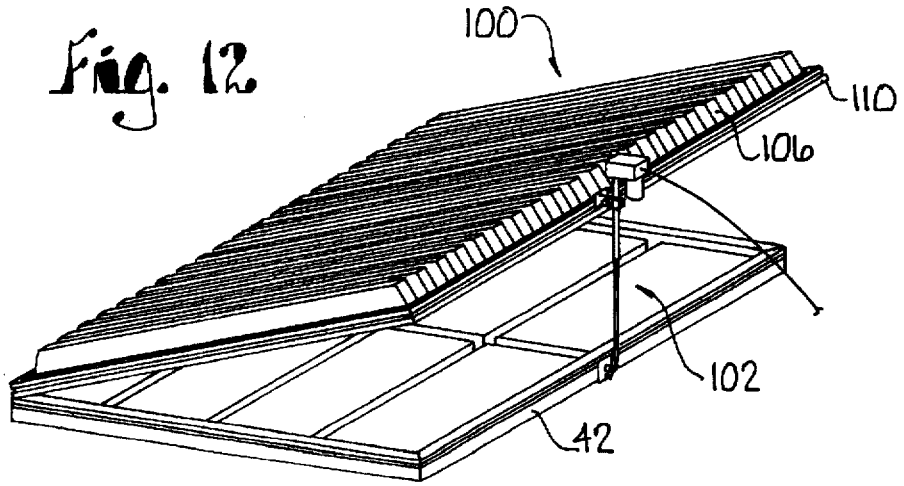

CONCRETE PANEL CONSTRUCTION AND MOLD

CROSS-REFERENCE

This application is a continuation-in-part of application Ser. No. 08/247,060 filed May 20, 1994.

BACKGROUND OF THE INVENTION

This invention relates to improvements in precast structural panel construction and in the molds for forming precast panels, particularly molds of this type having the advantages of light weight and portability and rapid stripping and resetting, and which provide an improved forming system as compared to the mold construction shown and described in my U.S. Pat. No. 4,181,286, issued Jan. 1, 1980.

In precast concrete wall and floor construction and other building applications, waffle-shaped panels and slabs provide numerous advantages including a substantial saving in material, weight and money, as well as an architecturally advantageous three-dimensional configuration. In residential and commercial buildings the waffle design offers complete freedom to fully insulate exterior walls, modular window units may be inserted in the voided areas of the waffle without sacrificing wall strength, and electrical wiring and plumbing runs can be installed after the building structure is erected. Many interior load-bearing walls and ceilings need only to be painted or textured to give a pleasing and economical open beam effect. Since the skin in the voided areas is relatively thin (as compared to the structural webs or ribs of the waffle), these areas are readily penetrated with drills and saws to facilitate plumbing and mechanical and electrical work.

Furthermore, the waffle design lends itself to the use of modular precast structural units that can be formed either at an in-plant location or at the site itself. For on-site production, it is important that the molds be lightweight and portable and easily stripped and reset for rapid production. Durability, reusability and simplicity are also important since the conveniences of a plant facility and in-plant production machinery are not available. The reinforced plastic molds shown and described in the aforesaid U.S. Pat. No. 4,181,286 answered this need for lightweight, easy-to-operate molds that are particularly suited for on-site production. Although these molds have been used for years and have proven to be very satisfactory, the efficiency of forming systems of this type is enhanced when durability can be increased, simplicity of mold design is maximized, operation is improved, and the quality of the molded product is thereby enhanced.

SUMMARY OF THE INVENTION

It is, therefore, an important object of the present invention to provide an improved mold for forming precast panels which offers advantages and features not provided by the reinforced plastic mold shown and described in the aforesaid patent.

Specifically, an important object of the invention is to provide such a mold in which the sidewalls of the mold body are provided primarily by rigid side rails in direct contact with the molded product, wherein a partial wall or flap is provided at the base of each sidewall by the flexible mold body material so that hinges are formed to permit swinging movement of the sidewalls between molding positions and positions releasing the molded product after the molding process is completed.

Another important object of this invention is to provide a mold as aforesaid in which longitudinal joints between the rigid side rails and the flexible mold body material permit the same to be readily separated by simply lifting the side rails from the mold body to facilitate replacement thereof after its useful life.

A further object of this invention is to provide a mold as aforesaid having a removable cover on the mold body with a selectively operable linear actuator connected to the cover for raising the cover from a closed position on the mold body to an open position exposing the waffle panel therein and having a timer for operating the linear actuator after a predetermined curing period so that the cover is automatically raised, thereby permitting the waffle panel to cool.

Other important objects include the provision of outwardly projecting upper edge portions on the side rails which overhang the lower portions thereof to keep the mold sides clean, sharp corners on the upper inside edges of the mold sides through the use of rigid side rails rather than flexible plastic sides, corner connections which facilitate vertical separation of the side rails from the mold body when replacement is required, tapered holeformers extending through the mold sides which are simple to use and are reusable, recess formers used in conjunction with the holeformers to conceal panel connections, flexible filler pieces that may be inserted in the mold to adapt the same for the formation of a thinner molded product, and precast covers for bolts left exposed after the construction of a waffle panel building.

Other objects will become apparent as the detailed description proceeds.

BRIEF DESCRIPTION OF THE DRAWINGS

FIG. 7 is a perspective view of an exemplary finished waffle panel formed by the mold of FIG. 1.

FIG. 10 is an enlarged top plan view of a recess former.

FIG. 11 is a cross-sectional view of the recess former taken along line 11—11 of FIG. 10.

FIG. 12 is a perspective view of a mold body and its cover opened to its cooling position by a linear actuator.

DETAILED DESCRIPTION

Figure 1:
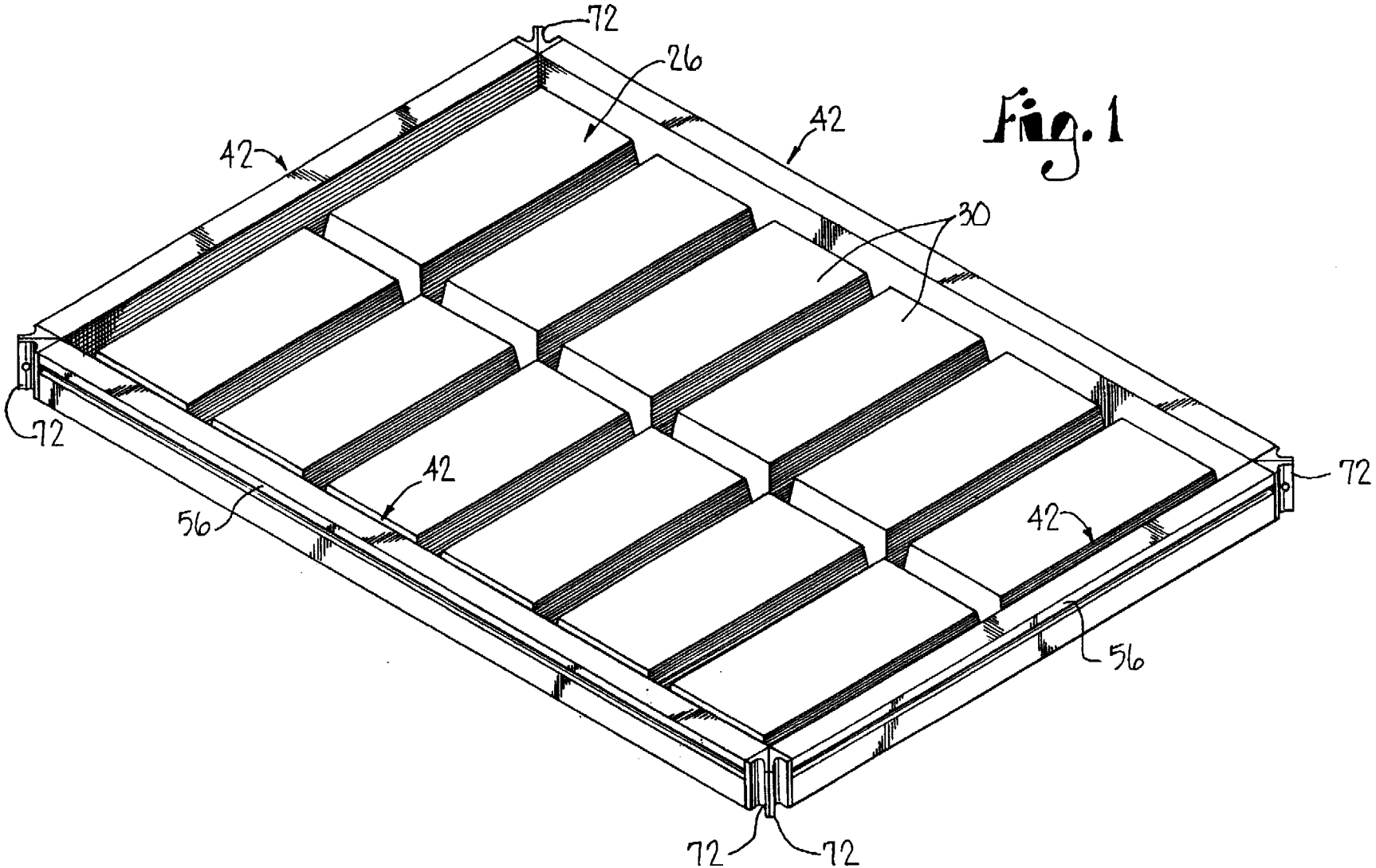
FIG. 1 is a perspective view of the mold of the present invention utilized in the production of precast waffle panels.

Referring initially to FIG. 7, a precast waffle panel of the type produced by the mold of FIGS. 1–6 is illustrated. Such panel is a modular unit of reinforced concrete that may be employed either as a wall, roof or floor panel. Panels of this type are characterized by a relatively thin skin 20, thick structural sides 22 defining the periphery of the panel, and integral webs or ribs 24. The webs 24 are spaced apart at regular intervals to define voids 25 where the thickness of the panel resides solely in the skin 20. Manifestly, the presence of the voids 25 provides a substantial saving of material and reduction in weight, without significant sacrifice of strength due to the presence of the structural webs 24 and sides 22. A typical panel is 8 feet in its transverse dimension, 12 feet long, and 8 inches thick at the sides 22 and webs 24. With a 2-inch thickness for the skin 20, the panel utilizes less than half of the concrete used in a solid 8-inch wall, roof or floor.

Now referring to FIGS. 1–6, the mold of the present invention employs a one-piece, flexible mold body having a panel-forming component 26 and four integral, partial side elements 28. The entire mold body constituting the component 26 and side elements 28 is formed from a single sheet of flexible material, such as a thermoformed ABS plastic. In order to impart the requisite waffle shape to the molded product, the forming component 26 is provided with spaced, raised portions 30. As an example, twelve such portions 30 in two rows of six each are illustrated in FIG. 1. Each of the portions 30 gives the appearance of a platform elevated above a base lattice 32 (see FIG. 2) which forms a grid at the bottom of the mold.

Each raised portion 30, by virtue of the use of a single piece of plastic sheet material, presents a downwardly facing cavity which is filled by a rigid plastic foam 34. This structurally reinforces the component 26 and rigidifies the raised portions 30, and also insulates the mold to assist in curing.

The two longitudinal and two transverse partial side elements 28 are pliable due to the flexible nature of the plastic sheet material and, therefore, present flaps swingable about lines of bend 36 at the merger of the side elements 28 with the outside edges of the lattice or grid portion 32 of the mold body to provide a hinge action for a purpose to be discussed. Each side element 28 terminates at an upper, free longitudinal edge 38 which is received within a complimentary longitudinal groove 40 formed in a tubular side rail 42. There are two longitudinal and two transverse side rails 42 coextensive with their associated side elements 28. Each side rail 42 and associated partial side element 28, therefore, form a complete sidewall of the mold body which compliments the panel-forming component 30 to impart the waffle configuration to the molded product. The side rails 42 are preferably formed from aluminum extrusions and thus present rigid box members surrounding the mold body which have sufficient structural strength to resist deformation under outwardly directed forces against the sidewalls produced when the mold body is filled with concrete. As disclosed in the aforesaid U.S. Pat. No. 4,181,286, it is important that the sides of the mold body be constructed such that outward bowing cannot occur when the mold is filled with concrete.

Figure 2:
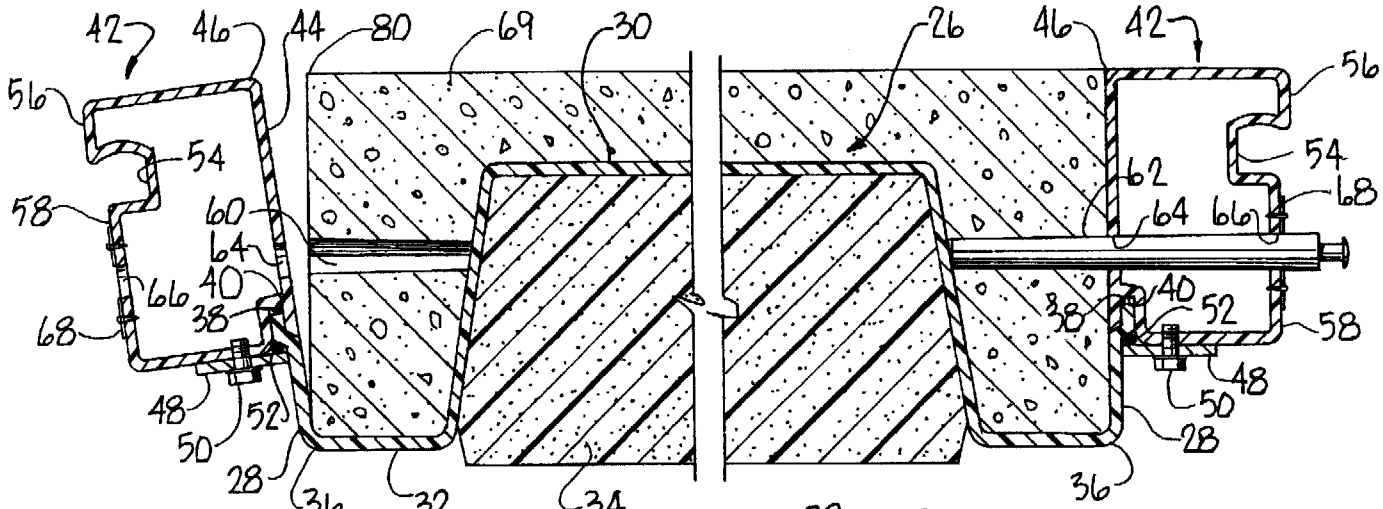
FIG. 2 is an enlarged, fragmentary view (partially in elevation and partially in vertical cross-section) of the mold of FIG. 1 filled with concrete, one of the sidewalls of the mold being shown swung outwardly to release the mold from the waffle panel.
Figure 6:
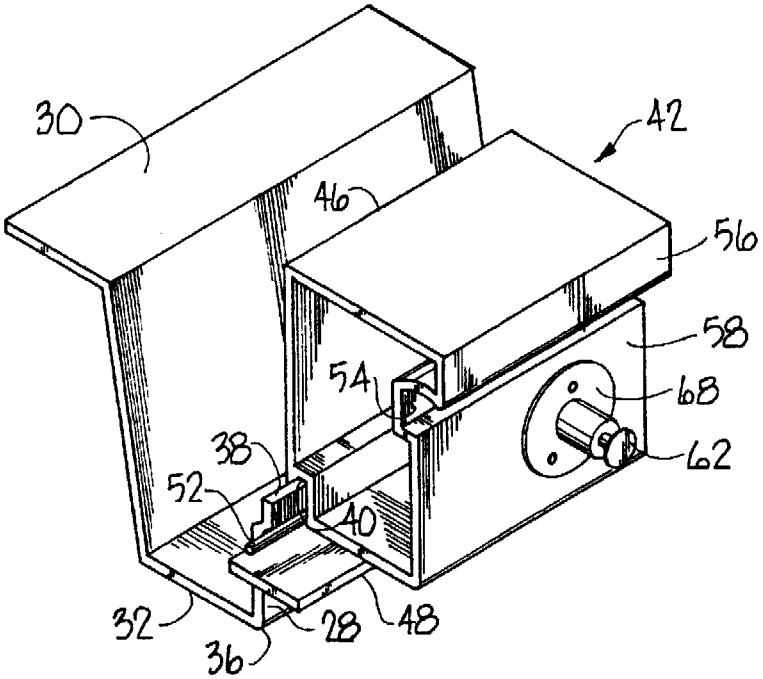
FIG. 6 is an enlarged, fragmentary, perspective view showing the joint between one of the side rails and the plastic mold body and revealing the outer end of one of the holeformers, parts being broken away at the joint to show details of construction.
Figure 8:
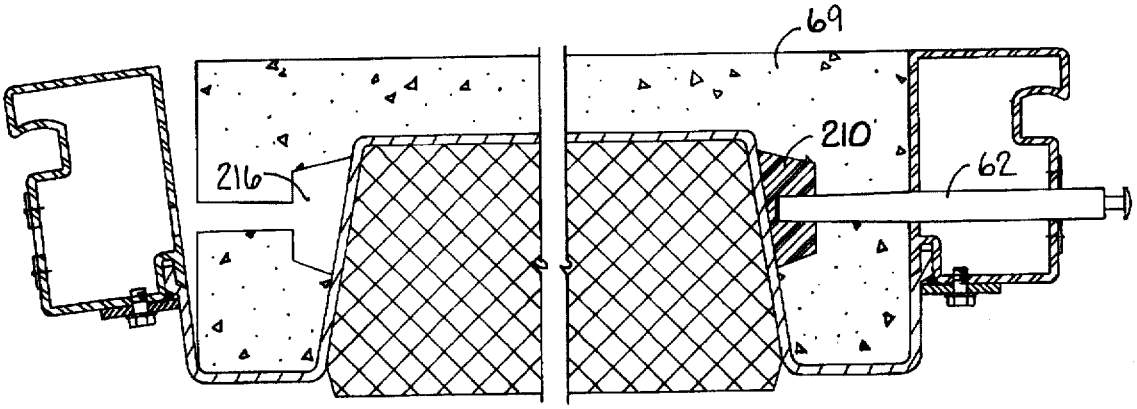
FIG. 8 is an enlarged, fragmentary view (partially in elevation and partially in vertical cross-section) of the mold of FIG. 1 with a recess shown as formed after removal of the former and with a recess former shown in cross-section.

The longitudinal joint between each side rail 42 and its associated partial side element 28 is best shown by a comparison of FIGS. 2 and 6. A tongue and groove connection is provided, the tongue thereof being formed by the Z-shaped upper longitudinal margin of the side element 28 which presents the longitudinal edge 38. The groove 40 in the tubular extrusion comprising side rail 42 is disposed at the lower, inner corner of the rail and thus the partial element 28 and rail 42, when joined, present a continuous inwardly facing molding surface 44. It should be appreciated that surface 44 is continuous and uninterrupted from the line of bend 36 upwardly to a right-angle corner 46 of the side rail 42 which defines the inner upper edge of the rail. A retainer strap 48 is secured to the bottom of rail 42 by screws 50 to hold the mated tongue and groove components together to prevent separation thereof, a spacer rod 52 being sandwiched between the strap 48 and the Z-shaped bend in side element 28 to hold the mated joint components in place by a clamping action. Both the retainer strap 48 and the spacer rod 52 are preferably aluminum.

Each side rail 42 has a longitudinal recess 54 in its outer side which serves as a finger hold for lifting and carrying the mold and also facilitates the clamping of an insulated cover over the mold body as best seen in FIGS. 12–16 and discussed in more detail below. The outer upper edge portion 56 of the rail 42 above the recess 54 projects outwardly beyond the lower portion 58 of rail 42 below recess 54 in order to provide an overhang so that any concrete that may overflow during the molding process will not drip and adhere to lower portion 58. This keeps the mold sides clean and prevents spillage from interfering with the use of the forming system of the present invention.

The forming of holes or passages 60 (FIG. 2) in the molded product is facilitated by the use of an elongated, tapered, cylindrical holeformer 62 at locations where it is desired to form through holes 60 in the sides 22 of the waffle panel (FIG. 7) for bolts that will be employed to assemble the finished panels into the desired structure. An inner wall opening 64 in the side rail 42 is aligned with an outer opening 66 of slightly larger diameter for the purpose of receiving the tapered holeformer 62, which may then be held in place by an annular retainer 68.

Figure 9:
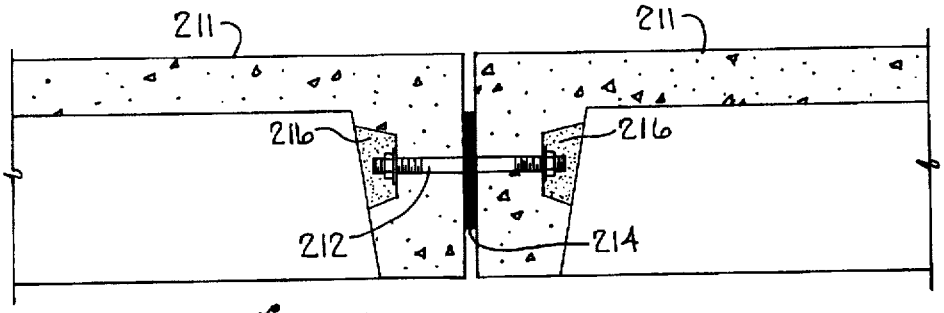
FIG. 9 is a partial view (partially in elevation and partially in vertical cross-section) of two waffle panels connected by a bolt recessed within two recesses formed by recess formers.

A recess former 210, as seen in FIGS. 8–11, is mounted on the interior end of each holeformer 62 at locations where recessed bolt or other connector heads within the molded product are desired, as in FIG. 9. Typically, double ended bolts, such as bolt 212, are used to connect abutting panels 211. A rigid plastic shim or spacer 214 is placed between the abutting panels to prevent the concrete from cracking due to overtightening. The bolt ends with nuts secured rest within recesses 216 with the bolt extending through both waffle panels 211 and shim 214 to thereby connect the waffle panels 211. Grout (not shown) would typically be added to fill the recesses and provide a smooth appearance, thereby totally concealing the bolt ends.

As seen in FIGS. 10 and 11, recess former 210 is generally donut shaped and may be molded from plastic; it includes a top surface 218 having a hole or aperture 220 extending axially therethrough and terminating within recess former 210. Hole 220 receives the interior end of a holeformer 62, as in FIG. 8. Bottom surface 222 of recess former 210 extends angularly between two sides 224 and 226 (as viewed in cross-section) which present an irregular frustoconical outer surface between top and bottom surfaces 218 and 222. Thus, recess former 210 tapers from bottom surface 222 to top surface 218 to provide a corresponding tapered recess 216.

Figure 5:
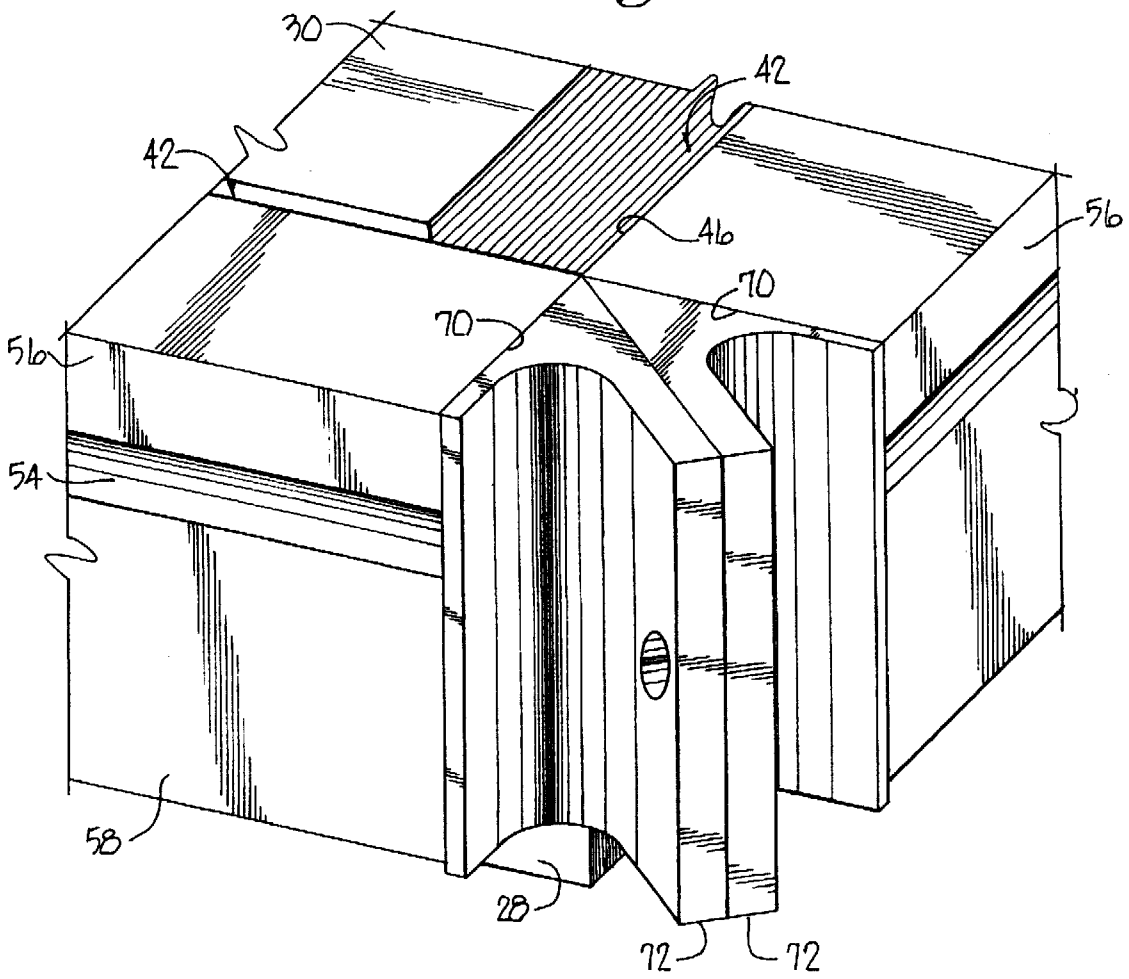
FIG. 5 is an enlarged, fragmentary, perspective view of one of the corners of the mold showing the same closed, the fastener for the end caps being removed for clarity.
Figure 4:
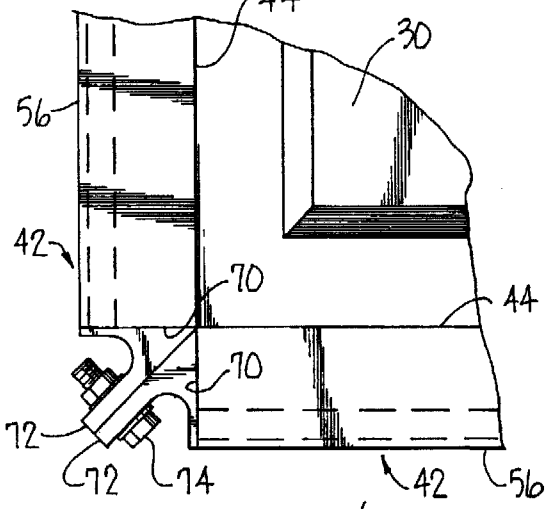
FIG. 4 is a plan view of one corner of the mold of FIG. 1 on a reduced scale as compared to FIG. 2.
Figure 1:
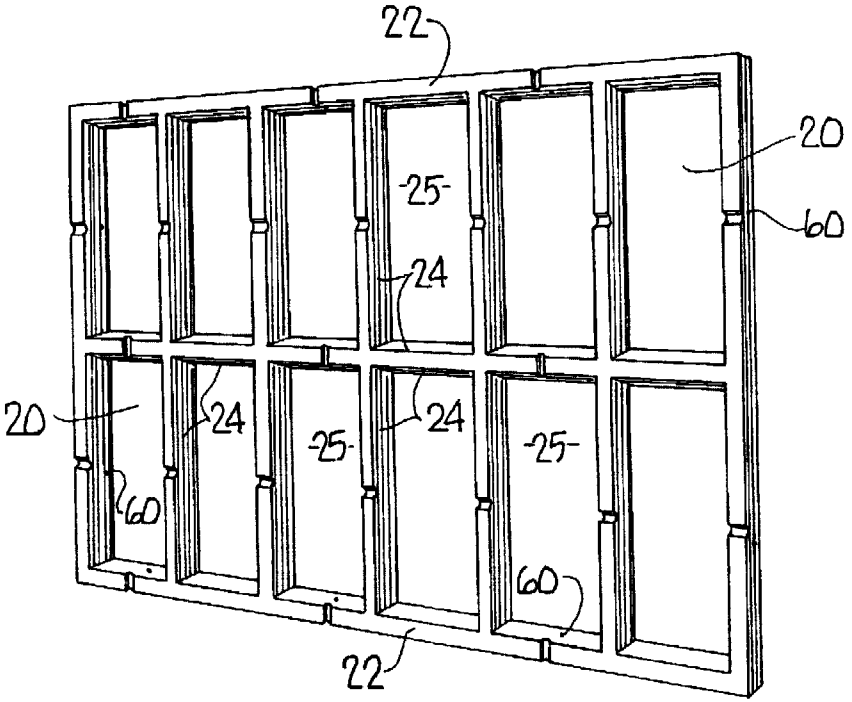

Referring to FIG. 2, it may be seen that the left sidewall of the mold there illustrated is shown in a partially open position separated from a concrete panel 69 which has cured in the mold. It may be appreciated, therefore, that the sidewalls of the mold have free end edges so that the four corners of the mold can be closed when casting the panel 69 and then opened to strip the mold once the concrete is cured. FIG. 4 reveals the free end edges 70 of two of the side rails 42 at one of the corners of the mold. An end cap 72 on each end edge 70 is secured to the adjacent end cap 72 by a bolt 74 to hold the corner closed. As illustrated in FIG. 5, the end caps 72 may be composed of aluminum and welded directly to the ends of the side rails 42. It should be appreciated that each end edge 70 lies in a vertical plane and that the surface-to-surface contact of the two end caps 72 (FIG. 4) likewise occurs in a vertical plane so that a simple and strong corner connection is provided by securing the two end caps 72 with the bolt 74. Furthermore, these components do not interfere with lifting the side rails 42 vertically off of the side elements 28 when it is necessary to replace the plastic mold body.

Figure 3:
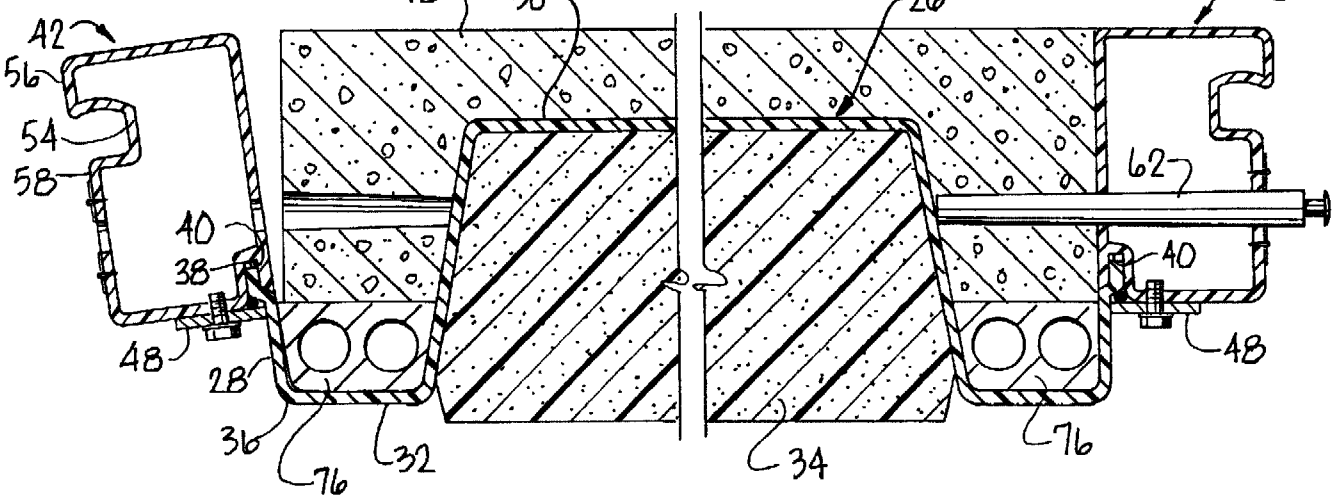
FIG. 3 is a view similar to FIG. 2 but showing filler pieces inserted in the mold to reduce the thickness of the panel.

Removable adapters 76 are shown in FIG. 3 installed in the bottom of the panel-forming component 26 in order to provide a thinner panel product 78 for lighter duty applications. The adapters 76 are flexible, PVC filler pieces and may be removed when it is desired to make the full panel 69 seen in FIG. 2. The adapters 76 would be employed, for example, to convert an eight-inch panel form to a six-inch form thereby producing the lighter, thinner panel 78.

Use of a mold of the general type disclosed herein is set forth in detail in the specification of the aforesaid U.S. Pat. No. 4,181,286 which is incorporated herein by reference as may be necessary for a full and complete understanding of the use and general operation of the mold disclosed herein. The improved forming system of the present invention, however, provides principally metal side surfaces 44 in contact with the molded product and thus a sharp upper, outer edge 80 is imparted to the molded product by the right angle corners 46 of the side rails 42. The tapered holeformers 62 are easily installed and removed and are reusable. The mold sides are kept clean by the projecting outer upper portions 56 of the side rails.

An important advantage in day-to-day operations is the structural simplicity of the improved forming system of the present invention and the ease by which a worn-out mold body may be replaced. To close the corners of the form for molding, the sidewalls are swung on the hinges provided by the partial side elements 28 to their upright positions and the bolts 74 are inserted and secured in the end caps 72. This simple operation closes the four corners of the mold. The holeformers 62 may then be inserted as desired. Once the concrete is cured, stripping is readily accomplished by removing the four bolts 74 at the corners and pulling the four sidewalls away from the molded product. The sidewalls swing outwardly about the lines of bend 36 at the base of the side elements 28.

The longitudinal tongue and groove joints between the side rails 42 and the side elements 28 facilitate the replacement of a worn mold body. The screws 50 are loosened to remove the retainer straps 48, whereupon the side rails 42 can be simply lifted off of the plastic body sides. As the end caps 72 are welded to the side rails 42, this one operation (separation of the tongue and groove joints) disassembles all metallic components from the plastic mold body for reuse. The side rails 42 are readily remounted on a replacement mold body by attaching the side rails to the replacement body at the tongue and groove joints and securing the retainer straps 48.

Concrete, after being poured into a mold body, is preferably covered and allowed to cure for a predetermined amount of time. Thereafter, the concrete must cool. Typically, the concrete is poured into the mold body during the day-time working hours and cures into the night and early morning, at which time it is preferable to remove the cover in order to accelerate the cooling process. Workers tend to be unreliable in removing the cover from the mold body during such hours, and manual removal increases labor costs. Accordingly, providing a cover 100 (FIGS. 12 and 13) which is automatically lifted from the mold body after the proper curing has occurred is desirable.

Figure 13:
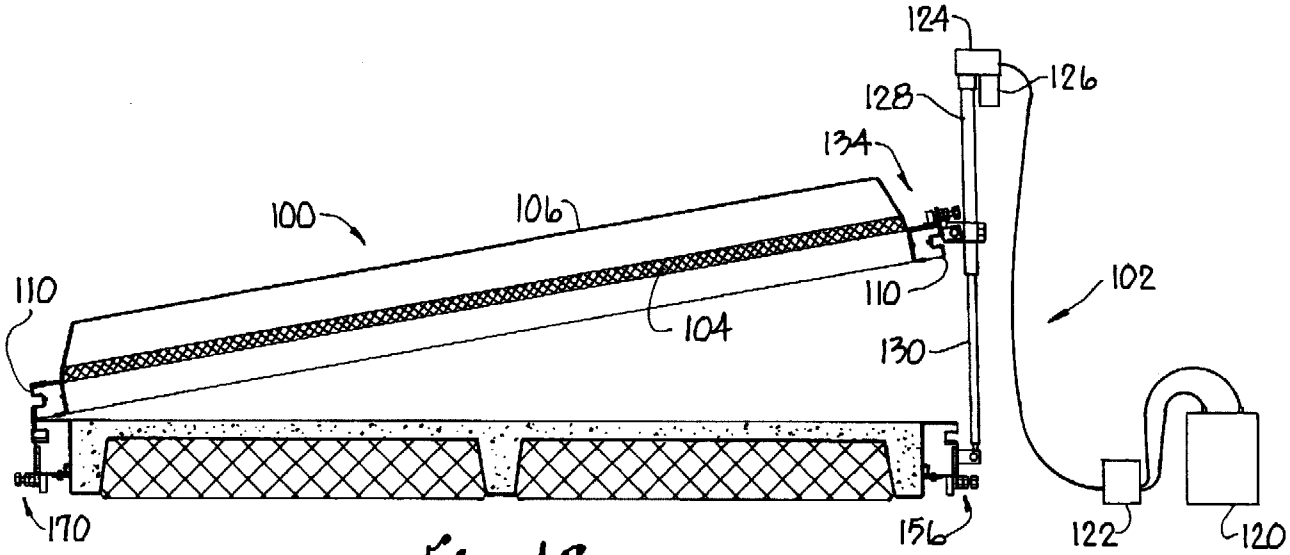
FIG. 13 is a transverse cross-section (partially in elevation) of the mold of FIG. 12 filled with concrete and the cover of FIG. 12 opened to its cooling position by a linear actuator.
Figure 14:
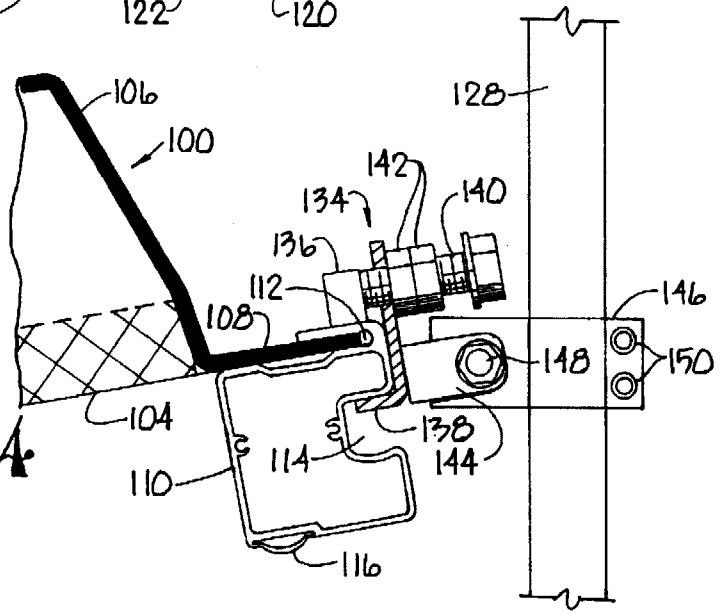
FIG. 14 is an enlarged, partial view (partially in elevation and partially in vertical cross-section) of the cover of FIG. 12 showing the clamping member connecting the cover to the linear actuator.

Cover 100 is the same shape and size as its corresponding mold body. The cover 100 is formed from a single sheet of plastic material to include a base member 104 (as seen in FIGS. 13 and 14) having a thickness filled with foam insulation, longitudinally spaced ribs or projections 106 (as seen in FIGS. 12 and 13) extending outwardly from and across the width of base member 104, and an edge portion 108 (as seen in FIG. 14) extending outwardly from the bottom of the base member 104 to form the periphery of cover 100. Elongated, rigid side rails 110 (as seen in FIGS. 12–14) are composed of extruded aluminum and are mounted on edge portion 108 by a tongue and groove connection. The tongue thereof is formed by the edge member 108 of cover 100 and is received within groove 112 of side rails 110. Each side rail 110 further includes a longitudinal recess 114 formed in its outer side which serves as a finger hold for lifting and carrying the cover 100 as well as a means of installing it on mold bodies. A flexible sealing member 116 is attached to the bottom side of each side rail 110 and provides a seal when brought into contact with the side rails 42 of the mold body. Typically, sealing member 116 is formed of common weather stripping. Ribs 106 provide strength to cover 100 and decrease the flexibility of cover 100 thereby making the cover easier to install, lift and remove from the mold body.

A cover lifter 102, as best seen in FIG. 13, preferably includes a conventional linear actuator employing an internal screw jack mechanism. Lifter 102 includes a battery 120 or other electrical power supply, a timer 122, an electric motor 126 connected to a gear drive 124, an upper actuator tube 128 and a lower actuator tube 130. The upper tube 128 is connected to one side of cover 100, preferably centered along its length at one of the side rails 110 as in FIGS. 12 and 13. At a predetermined time, as set on timer 122, the actuator is activated by closing the power circuit to motor 126. Upper tube 128 is hollow and extends from gear drive 124, and lower tube 130 extends downwardly from within upper tube 128. Tubes 128 and 130 are longitudinally extensible and retractable upon rotation of a screw (not shown) within the hollow interior thereof coupled to the gear drive 124. Thus, in operation, tubes 128 and 130 are telescopic and upon extension of lower tube 130 from upper tube 128, cover 100 is lifted from the mold body.

A first clamping member 134 connects the cover 100 to lifter 102, as best seen in FIG. 14. First clamping member 134 is secured to the side rail 110 of cover 100 by cam member 136 which is mounted on an L-shaped plate 138 by threaded bolt 140 and nuts 142. A surface of cam member 136 engages the top surface of side rail 110, and L-shaped plate 138 engages the top surface of the recess 114 formed in side rail 110 thereby clamping side rail 110 between cam member 136 and L-shaped plate 138. The first clamping member 134 is secured to upper tube 128 of lifter 102 by a pair of ears 144 projecting from the L-shaped plate 138, the outer ends of which are pivotally coupled to a pair of C-shaped brackets 146 by a cross-bolt 148. The C-shaped brackets 146 clamp upper tube 128 therebetween and are secured to upper tube 128 by two smaller bolts 150.

Figure 15:
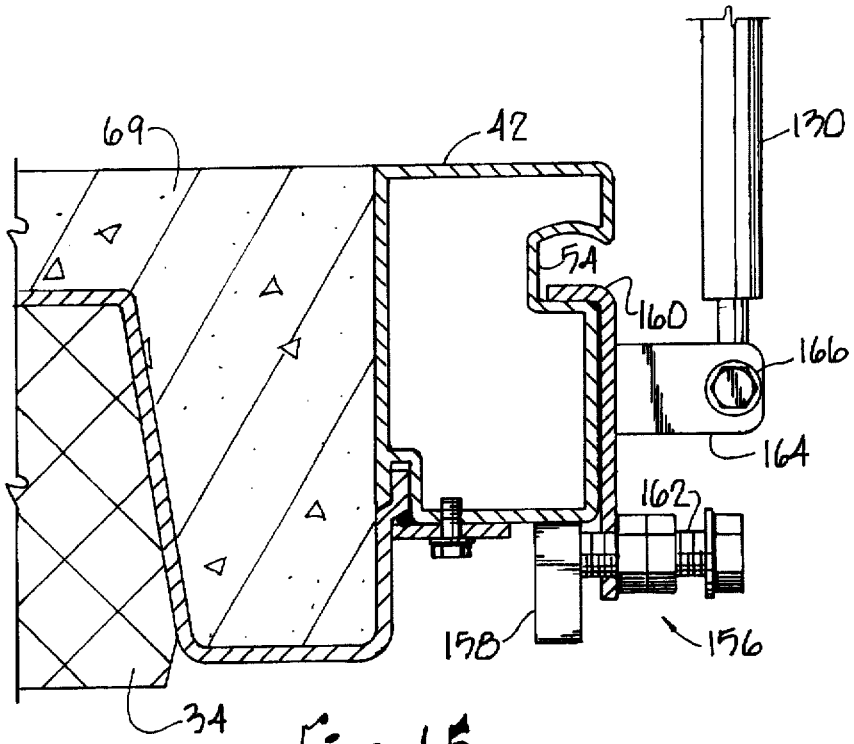
FIG. 15 is an enlarged, partial view (partially in elevation and partially in vertical cross-section) of the mold of FIG. 12 filled with concrete and showing the clamping member connecting the mold to the linear actuator.

A second clamping member 156 connects lower tube 130 of lifter 102 to the side rail 42 of the mold body directly below or in alignment with first clamping member 134, as seen in FIGS. 12 and 13. As best seen in FIG. 15, second clamping member 156 is similar to first clamping member 134 in that it is secured to side rail 42 by cam member 158 which is mounted on an L-shaped plate 160 by a threaded bolt 162. A surface of cam member 158 engages the bottom surface of side rail 42, and the L-shaped plate 160 engages the bottom surface of recess 54 to clamp side rail 42 of mold body therebetween. Second clamping member 156 is connected to lower tube 130 of lifting member 102 by parallel lugs 164 (only one shown) which extend outwardly from the side of plate 160 and are secured to lower tube 130 by a pivot bolt 166.

Figure 16:
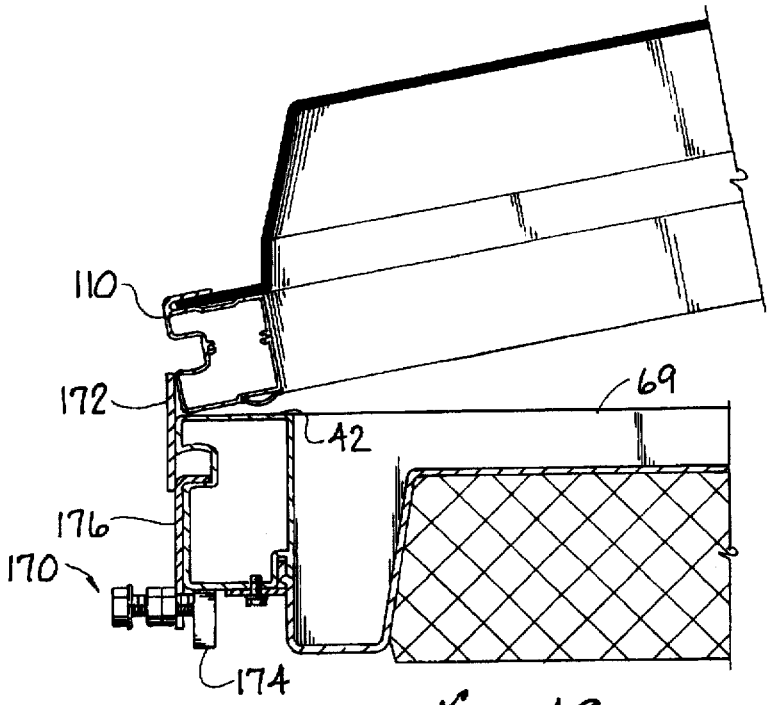
FIG. 16 is an enlarged, partial view (partially in elevation and partially in vertical cross-section) of the mold and cover of FIG. 12 showing the stop member preventing displacement of the cover in its open position.

A third clamping member 170 provides a stop plate 172 which prevents the displacement of cover 100 upon the activation of lifter 102 to raise cover 100 from the mold body and presents an axis about which cover 100 swings between its closed position and its open position. Third clamping member 170, as best seen in FIG. 16, is most commonly connected to the mold body directly opposite the first and second clamping members 134 and 156 when only one stop plate 172 is needed. However, to accommodate a long mold body, two or more spaced stop plates 172 may be utilized.

The third clamping member 170 includes a cam member 174, similar to cam member 158, which attaches stop plate 172 to the side rail 42 of the mold body. Stop plate 172 is joined to an L-shaped clamping plate 176, preferably by welding, and extends upwardly therefrom into engagement with the outer side of side rail 110 of cover 100.

Figure 17:
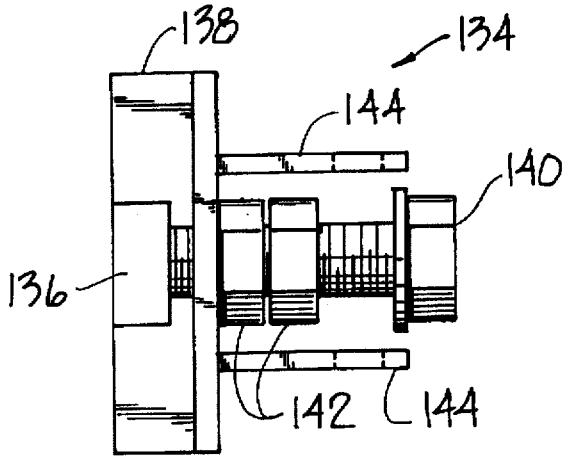
FIG. 17 is a top view of the clamping member of FIG. 14 but with the cover and linear actuator removed therefrom.
Figure 18:
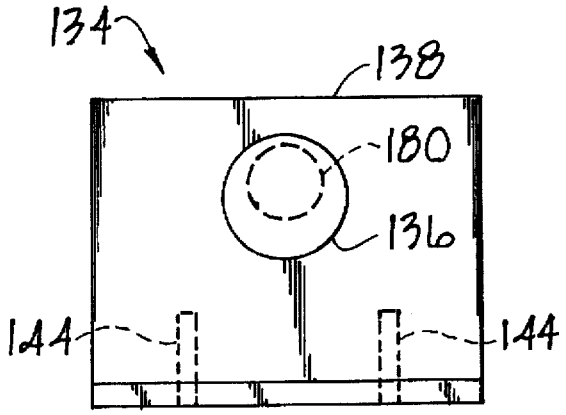
FIG. 18 is a left side view of the clamping member of FIG. 14 but with the cover and linear actuator removed therefrom.
Figure 19:
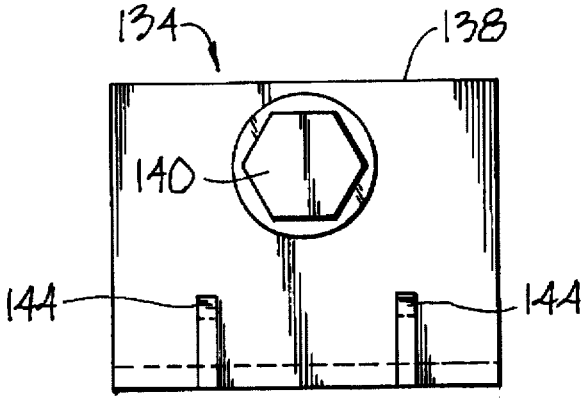
FIG. 19 is a right side view of the clamping member of FIG. 14 but with the cover and linear actuator removed therefrom.

Cam members 136, 158 and 174 are all substantially identical and may be formed from 1¼ inch round steel bars. For an example, see FIGS. 17–19, showing the first clamping member 134 in detail. An eccentric threaded bore 180 extends partially through cam member 136 and receives threaded bolt 140 therein.

Each cam member 136, 158 and 174 can be used with different sizes of the corresponding side rail 42 or 110. When used with smaller side rails 42 or 110, a surface of the cam that projects a greater radial distance will engage the corresponding side rail 42 or 110. During assembly, only a quarter turn or less of each cam member 136, 158 and 174 is needed to create a sufficiently tight connection between the side rail 42 or 110 and the corresponding clamping member 134, 156 and 170. The bolts and nuts provided for this purpose, e.g. 140–142, assure that the cams are fixed in their rail-engaging positions.

Figure 20:
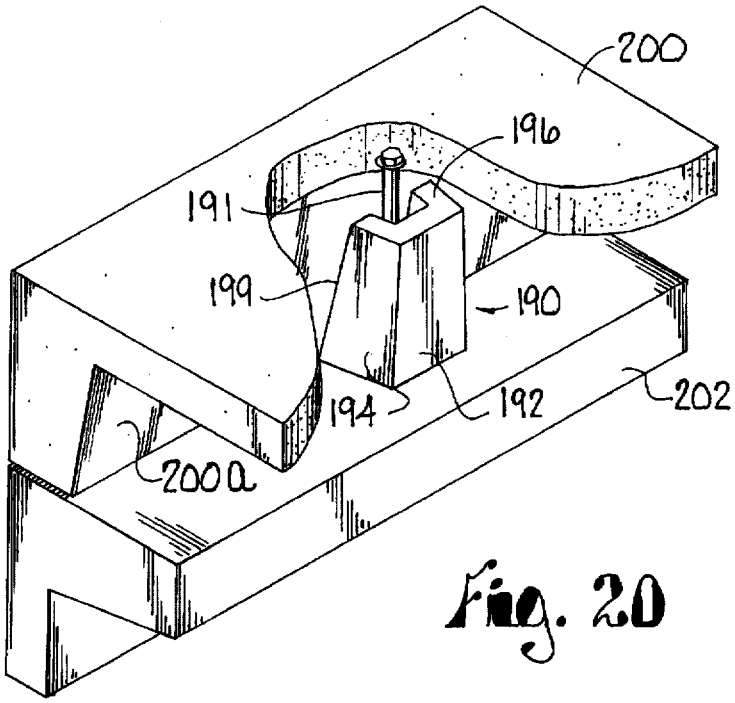
FIG. 20 is a perspective view of a bolt cover inserted over an exposed bolt between a roof waffle panel and a sidewall waffle panel but with the roof waffle panel broken away for clarity.
Figure 21:
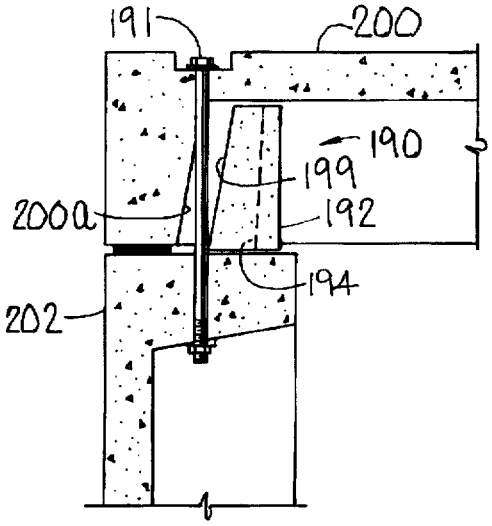
FIG. 21 is a vertical cross-section (parts shown in elevation) of the waffle panels and bolt cover of FIG. 20, showing the cover displaced to the right in a partially inserted position.
Figure 22:
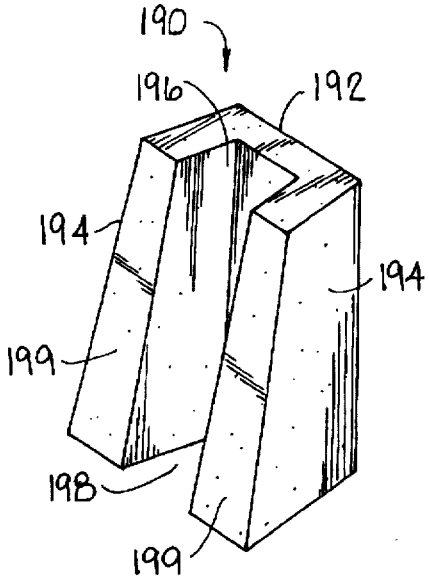
FIG. 22 is a perspective view of the bolt cover of FIG. 20.

Referring to FIGS. 20–22, a portion of a waffle panel structure is shown to illustrate a solution provided by the present invention to the problem of exposed connectors used to join a roof or ceiling waffle panel 200 to an exterior (or interior) wall panel 202. A bolt cover 190, as seen in FIGS. 20–22, is used to cover connectors, such as bolt 191 as seen in FIG. 20, left exposed during construction of waffle a panel building. Bolt cover 190 is substantially C-shaped and includes an inwardly facing side 192 and a pair of legs 194 as best seen in FIG. 22. Side and legs 192 and 194 each progressively thicken as they extend from the upper open end 196 to the lower open end 198 of bolt cover 190. Each of the legs 194 is also progressively wider presenting an angled distal surface 199 which extends between open ends 196 and 198 and complements the interior side surface **200*a* of the peripheral rib of panel 200. Bolt cover 190** is cast from concrete and is approximately 6 inches tall and 4 inches wide in typical applications.

In assembly, bolt cover 190 extends between the horizontally extending waffle panel 200, typically forming a ceiling, and the vertically extending waffle panel 202, typically forming a sidewall. Bolt cover 190 is shown partially installed (FIG. 21) spaced from interior side surface **200*a*, and is shown fully inserted around bolt 191 (FIG. 20) with angled surfaces 199 flush against the interior surface 200*a*, upper end 196 abutting against the bottom surface of the ceiling panel 200, and lower end 198 abutting against the top surface of the side panel 202. A suitable adhesive such as a mastic is applied to the abutting surfaces. Thus, bolt cover 190 extends between panels 200 and 202 to thereby conceal bolt 191. It may be appreciated, therefore, that bolt covers 190** give the appearance of ribs in structures where the interior is not finished. This materially improves appearance and also provides structural security by hiding the interconnecting bolts from thieves and vandals who might otherwise attempt to remove them.

Having thus described the invention, what is claimed as new and desired to be secured by Letters Patent is as follows:

1. A mold for forming precast panels, said mold comprising:

a mold body configured to impart a predetermined shape to a molded product formed therein, said body having a panel-forming component provided with a plurality of integral, flexible, elongated, partial side elements presenting the periphery of the body, each of said elements terminating at a longitudinal edge, a plurality of elongated, rigid side rails on respective elements longitudinally coextensive therewith, each of said side rails projecting from said longitudinal edge of the corresponding element and cooperating therewith to provide a sidewall of the mold body complementing said panel-forming component and presenting a continuous inwardly facing molding surface for forming the molded product, at least certain of said side rails having openings therethrough communicating with the interior of the mold body, a plurality of tapered holeformers received in corresponding openings of said side rails and extending into said mold body interior, a plurality of tapered recess formers mounted on respective interior ends of said holeformers and each having a substantially greater diameter than the associated holeformer, said sidewalls having end edges and the flexible elements thereof providing hinge means for swinging movement of the sidewalls on said component outwardly from normal, molding positions and away from a molded product within the mold body to permit said product to be withdrawn therefrom, the end edges of adjacent sidewalls defining closed corners of the body when said sidewalls are in their normal positions and, upon said outward swinging movement of the sidewalls, said end edges separating to cause said corners to open, and releasable means associated with said end edges for holding the corners closed to maintain the sidewalls in their normal positions during the molding process.

2. The mold as claimed in claim 1, wherein each of said recess formers has an aperture in one side thereof for receiving said interior end of the corresponding holeformer.

3. A mold structure for forming precast concrete panels, said mold structure comprising:

a mold body configured to impart a predetermined shape to a molded concrete product formed therein, said body having a panel-forming component provided with a plurality of integral, flexible, elongated side elements presenting the periphery of the body, a plurality of elongated, rigid side rails on respective elements extending longitudinally thereof, whereby each element and its associated side rail present a sidewall of the mold body, said flexible elements providing hinge means for swinging movement of the sidewalls on said component outwardly from normal, molding positions and away from a molded product within the mold body to permit said product to be withdrawn therefrom, releasable means for maintaining the sidewalls in their normal positions during the molding process, a removable, insulated curing cover on the mold body, said cover being composed of a plastic sheet material configured to impart sufficient thickness to the cover to provide an insulation-containing member substantially coextensive with the underlying mold body, and said cover presenting a peripheral edge and being provided with elongated, rigid side rails along said peripheral edge, selectively operable lifter means on one of said side rails of the mold body and coupled to a corresponding side rail of the cover for raising the cover from a closed position on the mold body to an open position exposing a molded product therein, and a timer for operating said lifter means after a predetermined curing period, whereby to automatically raise the cover to permit the molded product to cool.

4. The mold structure as claimed in claim 3, wherein said one of said side rails of the mold body has a longitudinal recess in an outer side thereof, and wherein said mold structure further comprises means engaging said one of said side rails within said recess for clamping said lifter means on said one of said side rails.

5. The mold structure as claimed in claim 4, wherein said corresponding side rail of the cover has a longitudinal recess in an outer side thereof, and wherein said mold structure further comprises means engaging said corresponding side rail of the cover within said recess for clamping said lifter means thereon.

6. The mold structure as claimed in claim 3, wherein a portion of said peripheral edge presents an axis about which said cover swings between its open and closed positions.

7. The mold structure as claimed in claim 6, further comprising a stop means connected to another of said side rails of said mold body for engaging a corresponding side rail of said peripheral edge portion to prevent displacement of said cover other than about said axis.

* * * * *